United States Patent [19]

Knowlton

[11] Patent Number: 4,619,060

[45] Date of Patent: Oct. 28, 1986

[54] PLOW COUPLING

[76] Inventor: Leland P. Knowlton, 80 Forest St., Worcester, Mass. 01609

[21] Appl. No.: 751,247

[22] Filed: Jul. 2, 1985

[51] Int. Cl.[4] ..... E01H 5/06

[52] U.S. Cl. ..... 37/231; 37/283

[58] Field of Search ..... 37/232, 231, 234–236, 37/283; 172/272, 274, 275, 829–830

[56] References Cited

U.S. PATENT DOCUMENTS

| | | | |
|---|---|---|---|
| 3,410,008 | 11/1968 | Standfuss | 37/231 |
| 3,775,877 | 12/1973 | Gove, Sr. | 37/232 |
| 3,807,065 | 4/1974 | Billingsley | 37/283 |
| 3,845,577 | 11/1974 | Naymik | 37/231 |
| 3,987,562 | 10/1976 | Deen et al. | 172/275 X |
| 4,127,951 | 12/1978 | Hatch | 37/231 |
| 4,238,895 | 12/1980 | Hetrick | 37/236 |
| 4,244,122 | 1/1981 | Hetrick | 37/234 |
| 4,255,884 | 3/1981 | Williams | 37/231 |
| 4,342,163 | 8/1982 | Hoekstra | 37/231 |
| 4,383,381 | 5/1983 | Wirsbinski | 37/283 |

FOREIGN PATENT DOCUMENTS

| | | | |
|---|---|---|---|
| 264534 | 1/1950 | Switzerland | 37/232 |

*Primary Examiner*—E. H. Eickholt

*Attorney, Agent, or Firm*—Blodgett & Blodgett

[57] ABSTRACT

Coupling for a plow comprising, a pair of mounting tabs which are fixed to the rearward ends of a pair of arms which form part of a supporting frame for a plow. Each tab comprises a flat plate which includes an opening at the rear edge, a first slot which extends forwardly from the opening and which terminates in a forward edge and a second slot which extends rearwardly from the forward end of the first slot and which terminates in a rearward edge. The opening is adapted to receive a connecting pin of a push beam which is attached to the plow vehicle. The first slot is adapted to receive the pin, so that the pin rests against the forward edge when the plow is pushed forwardly by the plow vehicle. The second slot is adapted to receive the pin from the first slot so that the pin rests against the rearward edge when the plow is being pulled rearwardly by the plow vehicle. The invention also comprises a mounting tab such as that described above which is adapted to be mounted to a conventional plow supporting frame.

18 Claims, 12 Drawing Figures

FIG 6
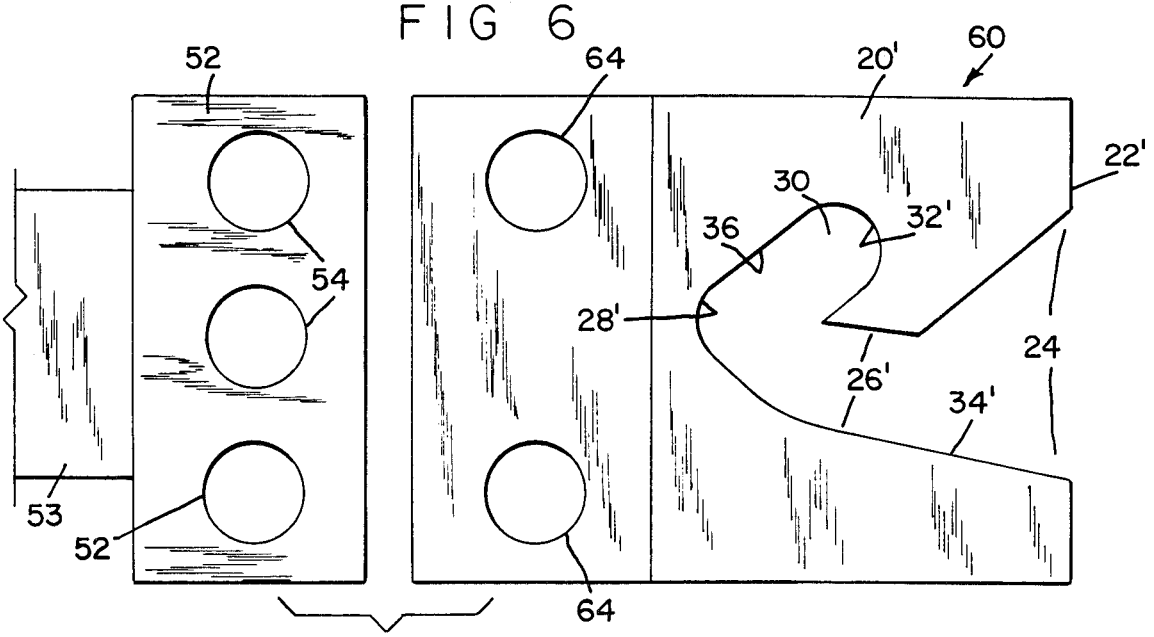
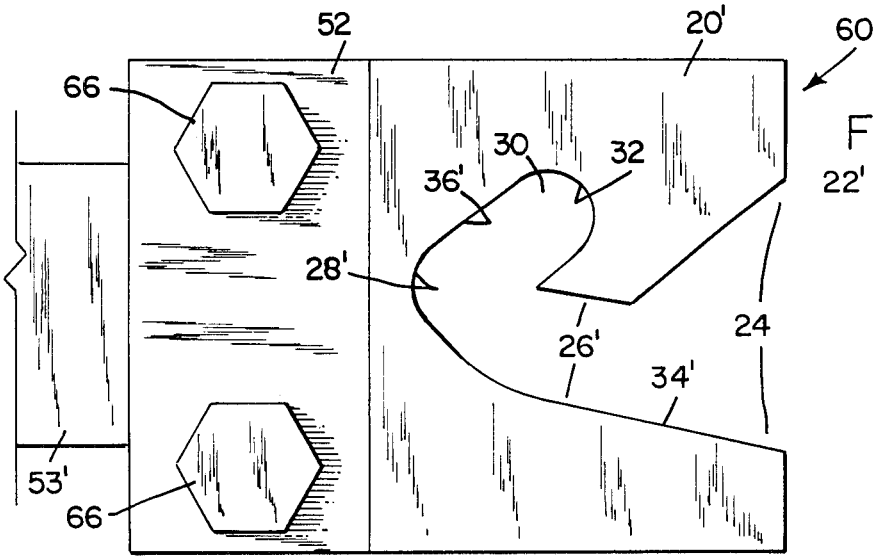
FIG. 7
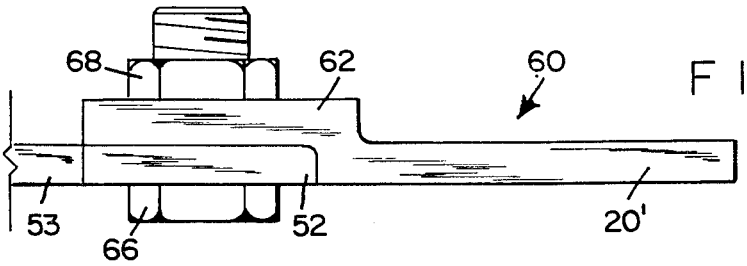
FIG. 8

FIG. 9
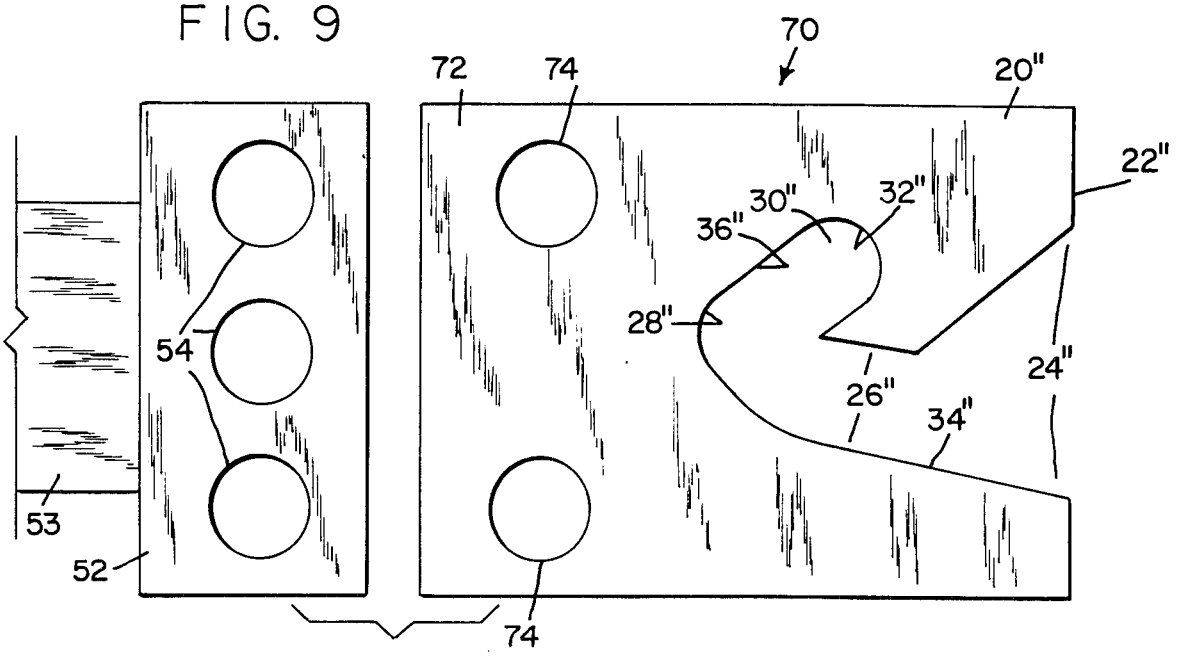
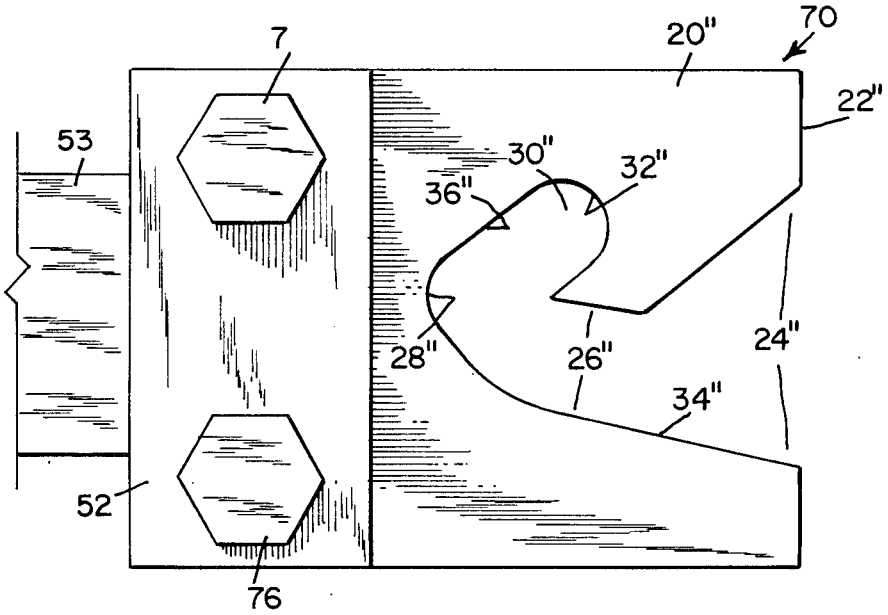
FIG. 10
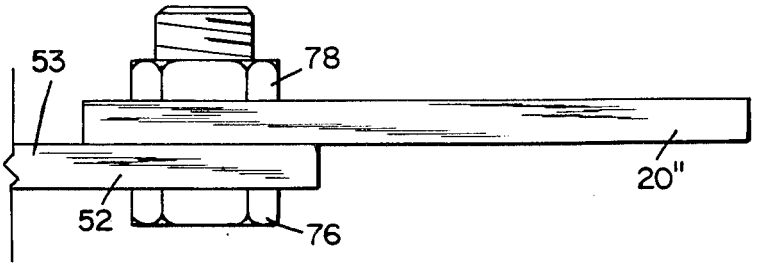
FIG. 11

PLOW COUPLING

BACKGROUND OF THE INVENTION

The present invention relates generally to coupling means for a snow plow and, more specifically, to automatic coupling and uncoupling means.

A conventional snow plow includes framework which is fixed to the back of the plow. The framework is adapted to be connected to an "A-frame" which is provided with hydraulic actuating means for angling the plow. The "A-frame" is also provided with coupling means for coupling with complimentary coupling means of framework which is attached to the front of the plow vehicle. This latter framework is generally referred to as a "pushbeam" and includes a pair of spaced guides for receiving a pair of spaced tabs which extend rearwardly from the "A-frame". Each tab has a plurality of apertures and is adapted to fit into one of the guides of the "push beam". A retractable connecting pin is associated with each guide. The pin extends laterally through apertures in the guide and through one of the apertures of the tab, when the tab is positioned within the guide, so that one of the apertures of the tab is axially aligned with the apertures of the guide.

During periods when the plow is not being used, it is disconnected from the vehicle and stored in a location where the vehicle can be driven up to the "A-frame" of the plow for recoupling. Normally, the "A-frame" is mounted on blocks at a height which enables the tabs to be at the same height as the guides in the "push beam". The connecting pins are pulled out of the guides and the vehicle is advanced toward the A-frame, so that the tabs enter the guides. Most of the time, the apertures in the guides are misaligned with the apertures in the tabs. The tabs are aligned within the guides by means of lift chains which are connected to a hydraulically operated lever in the vehicle. After the apertures in the guides are aligned with corresponding apertures in the tabs, the connecting pins are reinserted into the guides and through the tabs. The entire operation of coupling the plow to the plow vehicle is awkward and time-consuming, particularly if the entire operation is performed by a single individual. First of all, it is extremely difficult for an individual to advance the vehicle toward the "A-frame", so that the tabs are horizontally aligned with the guides. Very often, several attempts must be made before the tabs are generally aligned with the guides, so that they can be advanced into the guides. The individual must make several trips into and out of the vehicle. When the operation is performed by two individuals, one individual can stay in the vehicle while the other individual attempts to direct the movement progress of the vehicle. Even with two individuals, several reciprocations of the vehicle must be made before the tabs are aligned within the guides. Thereafter, the "A-frame" must be manipulated vertically to properly align the apertures of the guide with corresponding apertures in the tabs. Under ideal weather conditions, the entire coupling operation is difficult enough. However, most of the time weather conditions are substantially less than ideal. Due to the purpose for which snowplows are used, coupling typically occurs during stormy and cold conditions. In addition, most snowplowing begins in the early morning hours when it is dark. There is always a certain degree of emergency to get started and coupling under less than ideal conditions can be very frustrating to the operator. These and other dificulties experienced with the prior art devices have been obviated by the present invention.

It is, therefore, a principal object of the present invention to provide a plow coupling which enables a plow to be coupled and uncoupled automatically.

Another object of this invention is the provision of a plow coupling which does not require connecting pins.

A further object of the present invention is the provision of a mounting tab which is adaptable to a conventional plow coupling for providing automatic coupling and uncoupling of a plow.

It is another object of the present invention to provide an automatic plow coupling which does not require precise, vertical, or horizontal orientation of the plow vehicle relative to the plow.

A still further object of the invention is the provision of releasable connecting means for automatic uncoupling of an automatic plow coupling.

It is a still further object of the invention is to provide an automatic plow coupling which is simple in construction, which is inexpensive to manufacture, and which is capable of a long life of useful service with no maintenance.

With these and other objects in view, as will be apparent to those skilled in the art, the invention resides in the combination of parts set forth in the specification and covered by the claims appended hereto.

SUMMARY OF THE INVENTION

In general, the invention consists of a supporting frame which is attached to the back side of the plow and which has a pair of spaced rearwardly extending arms, and mounting tabs which are fixed to the rearward ends of the arms. Each tab comprises a flat plate which includes an opening at the rear portion of the plate, a first slot which extends forwardly from the opening, and a second slot which extends rearwardly from the forward portion of the first slot. The first slot terminates in a forward edge and the second slot terminates in a rearward edge. The first and second slots are adapted to receive a connecting pin, so that when the plow vehicle is advanced forwardly, the pin rests against the forward edge of the first slot and, when the vehicle is moved in reverse, the pin rests against the rearward edge of the second slot. The invention also comprises a mounting tab as described above which is adaptable to a conventional plow frame.

BRIEF DESCRIPTION OF THE DRAWINGS

The character of the invention, however, may be best understood by reference to one of its structural forms, as illustrated by the accompanying drawings, in which:

FIG. 6 shows a second embodiment of a mounting tab of the present invention which is adapted to be mounted to a conventional mounting tab of a plow frame, FIG. 7 is a side elevational view of the mounting tab of FIG. 6 connected to a conventional mounting tab, FIG. 8 is a plan view of the second mounting tab embodiment of FIG. 7, FIG. 9 is a side elevational view of a third embodiment of a mounting tab of the present invention, FIG. 10 is a view similar to FIG. 9, showing the mounting tab of FIG. 9 attached to a conventional mounting tab, FIG. 11 is a plan view of the mounting tab of FIG. 10.

DESCRIPTION OF THE INVENTION

Figure 1:
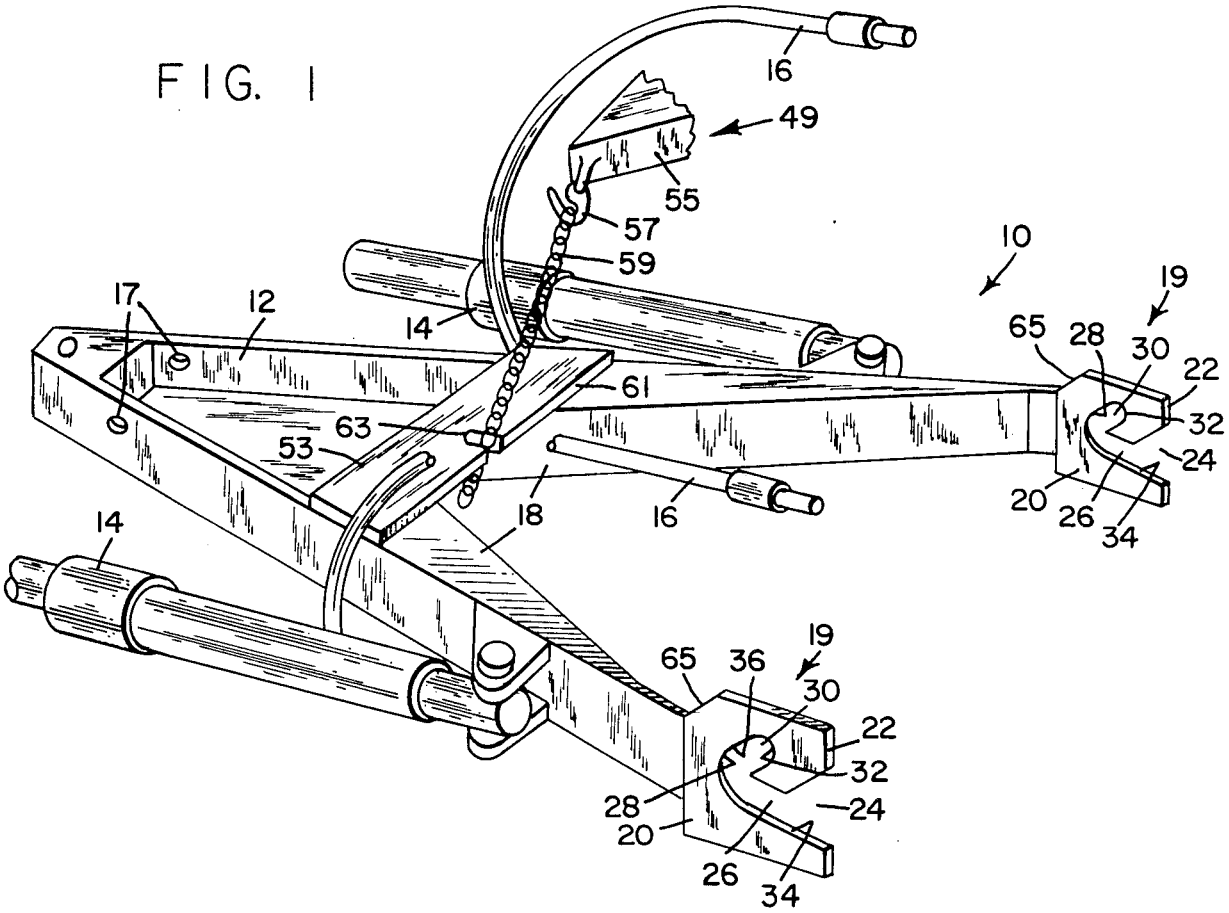
FIG. 1 is a perspective view of a plow coupling embodying the principles of the present invention.
Figure 3:
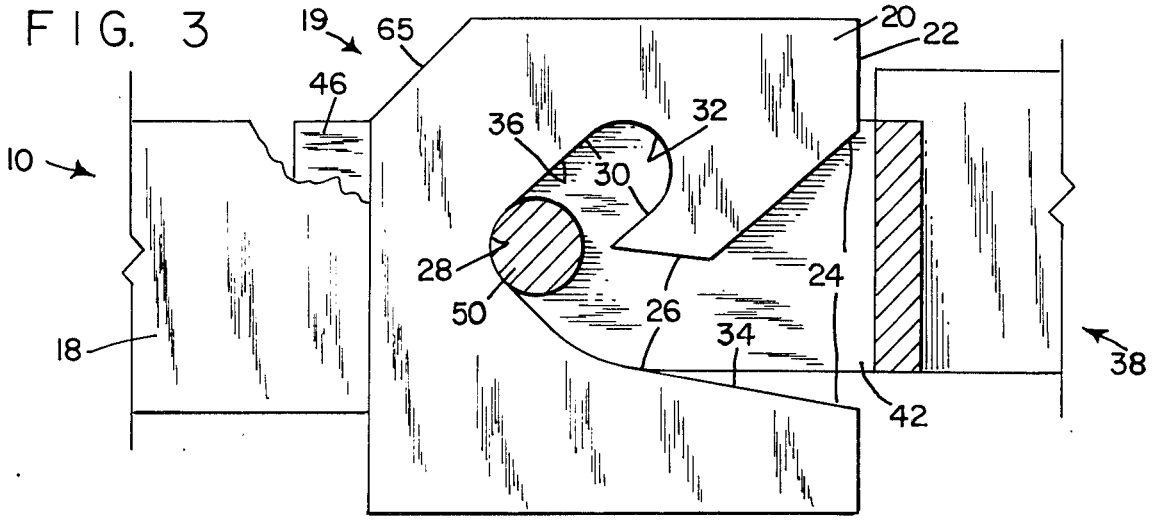
FIG. 3 is a fragmentary cross-sectional view showing a mounting tab of the present invention coupled to the push beam when the vehicle is being driven forwardly.
Figure 4:
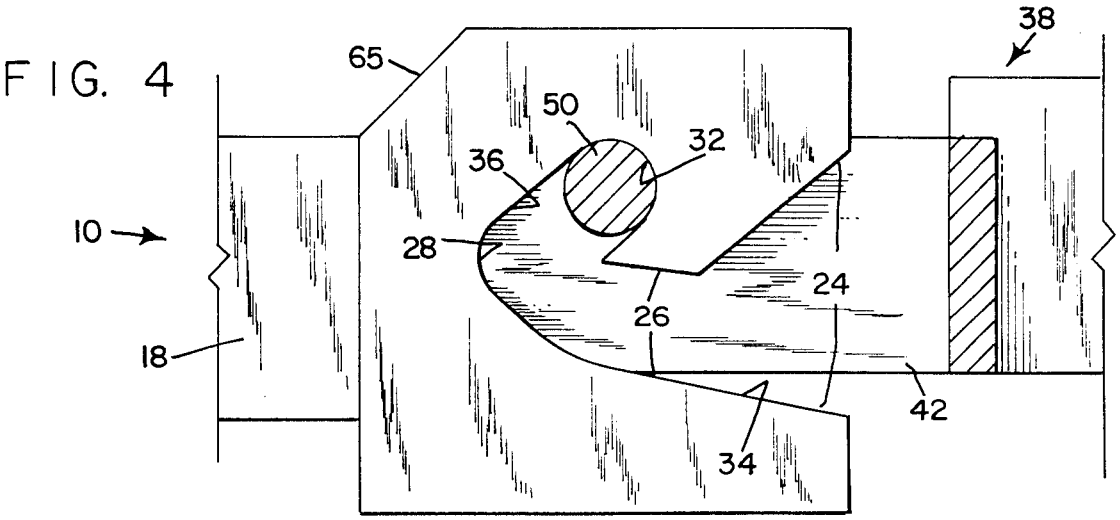
FIG. 4 is a view similar to FIG. 3, showing the orientation of the coupling elements when the plow vehicle is being driven rearwardly.

Referring first to FIG. 1, the plow coupling means of the present invention is generally indicated by the reference numeral 10 and includes a supporting frame 12 which is adapted to be mounted to the back side of a plow. The supporting frame 12 is of conventional A-frame construction and includes a pair of hydraulic cylinders 14 which are adapted to be connected to the hydraulic system of the plow vehicle by means of hydraulic lines 16 for controlling the horizontal plow angle. The forward end of the supporting frame is provided with apertures 17 for receiving lifting and carrying chains. The lifting and carrying chains (not shown) are connected to hydraulically controlled actuating levers for supporting the plow and for controlling the height of the plow. The supporting frame 12 also includes a pair of rearwardly-extending spaced arms 18. The rear end of each arm 18 is connected to a mounting tab which is generally indicated by the reference numeral 19, see also FIGS. 3 and 4.

Each mounting tab 19 comprises a flat plate 20 which lies in a vertical forward to back plane. The plate 20 has a V-shaped opening 24 in the rear edge 22 of the plate. A first slot 26 extends forwardly at an incline from the opening 24 and terminates in a forward edge 28. A second slot 30 extends rearwardly and upwardly from the forward edge 28 and terminates in a rearward edge 32. The first slot 26 is defined, in part, by a lower edge 34 and a second slot 30 is defined, in part, by an upper edge 36. The edges 34 and 36 are each connected to the forward edge 28.

Figure 2:
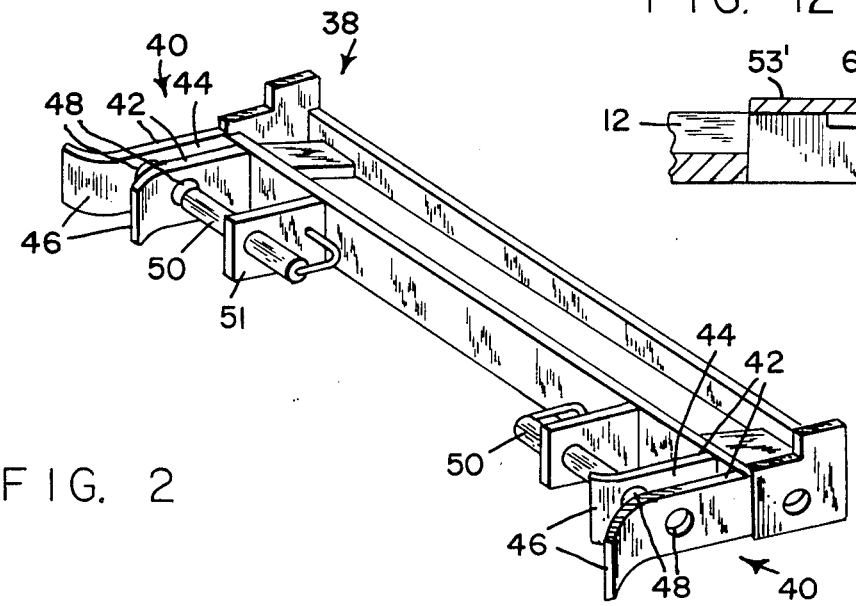
FIG. 2 is a perspective view of a push beam which is attachable to the plow vehicle and which is adapted to be coupled to the coupling means, illustrated in FIG. 1.

Referring to FIG. 2, there is shown a push beam, generally indicated by the reference numeral 38, which is adapted to be mounted to the front of the plow vehicle. The push beam 38 extends horizontally and includes at each end thereof a coupling element, generally indicated by the reference numeral 40. Each coupling element 40 comprises a pair of forwardly extending spaced arms 42 which terminate in flared ends 46. The arms 42 define therebetween a guide slot 44. Each arm 42 has an aperture 48 and the apertures 48 are axially aligned. A connecting pin 50 is slidably mounted on a bracket 51 for axial movement through the apertures 48, so that it extends across the opening 44. The coupling elements 40 are adapted to receive the mounting tabs 19 for coupling the plow to the plow vehicle.

Referring to FIG. 1, there is shown releasable connecting means, generally indicated by the reference numeral 49.

The operation and advantages of the present invention will now be readily understood in view of the above description.

Referring to FIGS. 1 and 2, the frame 12 is mounted to the rear side of the plow and the push beam 38 is mounted to the front of the plow vehicle. When the plow is not being used, it is stored in a location which is accessible to the plow vehicle. The plow is normally mounted on blocks so that the mounting tabs 19 are elevated and extend above the ground a distance which is approximately equal to the height of the guide slots 44. The plow vehicle is driven toward the mounting tabs 19, so that the tabs 19 enter the guide slots 44. The pins 50 are positioned so that they are located in the apertures 48 and extend across the slots 44. The flared ends 46 cam the mounting tabs 19 into the guide slots 44 so that the tabs 19 do not have to be perfectly aligned with the guide slots in the horizontal direction as the plow vehicle approaches the supporting frame of the plow. As each mounting tab 19 enters its respective guide slot 44, the connecting pin 50 enters the opening 24. The mouth of the opening 24 is considerably larger than the diameter of the connecting pin 50 and converges toward the first slot 26. This compensates for a certain degree of vertical misalignment between the connecting pin 50 and the first slot 26. If the pin is slightly below the slot 26, it will strike the lower edge 34 and be cammed into the slot 26. If the pin 50 is located slightly above the slot 26, it will strike an upper edge 52 which defines the upper limit of the opening 24 and be cammed downwardly into the slot 26. Continued forward motion of the plow vehicle causes the pin 50 to advance along the slot 26 until it reaches the forward edge 28. The forward edge 28 is curved and has a radius which is approximately equal to the radius of the pin 50. The rear end of the A-frame 12 is supported on the pins 50 so that the upper edges 36 bear downwardly against the pins 50. As long as the plow vehicle is driven in a forward direction, each pin 50 will be urged forwardly and remain in contact with the forward edge 28. These pins 50 will remain in this position as long as the plow vehicle is being driven in a forward direction to push the plow. When the plow vehicle is driven in reverse, the rear end of the A-frame has a tendency to drop and the rearward motion of the plow vehicle causes each pin 50 to ride along the second slot 30 until it strikes the rearward edge 32. The plow can then be either dragged along the ground for pulling snow in restricted locations or lifted from the ground so that the plow can be backed away in preparation for another forward sweep. When the plow vehicle is again driven forwardly, each pin 50 advances forwardly along its respective slot 30 until it comes to rest again against the forward edge 28.

The plow is uncoupled from the plow vehicle by uncoupling means generally indicated by the reference numeral 49. Uncoupling means 49 comprises a cross brace 53 which is fixed to the top of the arms 18 and a chain 59 which is adapted to be connected to a hook 57 which extends from the hydraulically actuated lifting element 55 of the plow vehicle. The cross brace 53 has a rear edge 61 which has a notch 63. When it is desired to uncouple the plow, the chain 59 is attached to the hook 57 and slipped into the notch 63. The lifting element 55 is raised, thereby forcing the lower edges 34 of the tabs against the pins 50, the plow vehicle is then driven in reverse. This causes the pins 50 which are bearing against the lower edges 34 to slide rearwardly along the first slots 26 and, finally, to pass out of the mounting tabs 20 through the openings 24. The rear end of the A-frame 12 is supported by the chain 59 as the pins 50 pass rearwardly through slots 26. As the plow vehicle moves rearwardly, the lifting element also moves rearwardly, so that the chain 59 is pulled out of the notch 63 just as the pins 50 reach the openings 24 of the tabs 19. As the chain is pulled out of the notch 63, the pins 50 will be free of the tabs 19 and the rear end of the A-frame will be free to drop. It is preferred that blocks be placed beneath the tabs 19 prior to uncoupling to support the rear end of the A-frame so that it is properly positioned for recoupling.

Figure 12:
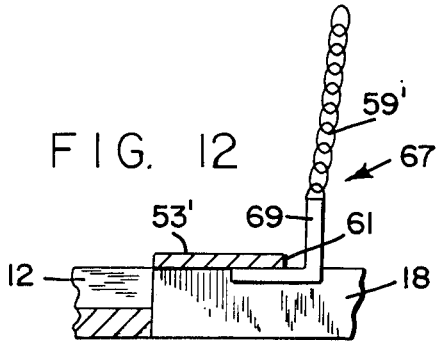
FIG. 12 is a fragmentary view showing a modified releasable connecting means for uncoupling the coupling of the present invention.

Referring to FIG. 12 there is shown a modified uncoupling means, generally indicated by the reference numeral 67. Uncoupling means 67 includes a cross brace 53' which is identical to cross brace 53 except that there is no notch in the rearward edge 61'. Uncoupling means 67 also includes an L-shaped bracket 69. One leg of the bracket 69 is adapted to be attached to the chain 59' and the other leg of the bracket 69 is adapted to engage the under side of the cross brace 53'. The uncoupling means 67 operates in the same manner as the uncoupling means 49. The A-frame 12 is supported by the bracket 69. As the plow vehicle is driven rearwardly to uncouple with the A-frame, the bracket 69 will be pulled away from the cross brace 53' to release the A-frame. This release occurs when the pins 50 are clear of the slots 26 and are thereby released from the tabs 19.

Figure 5:
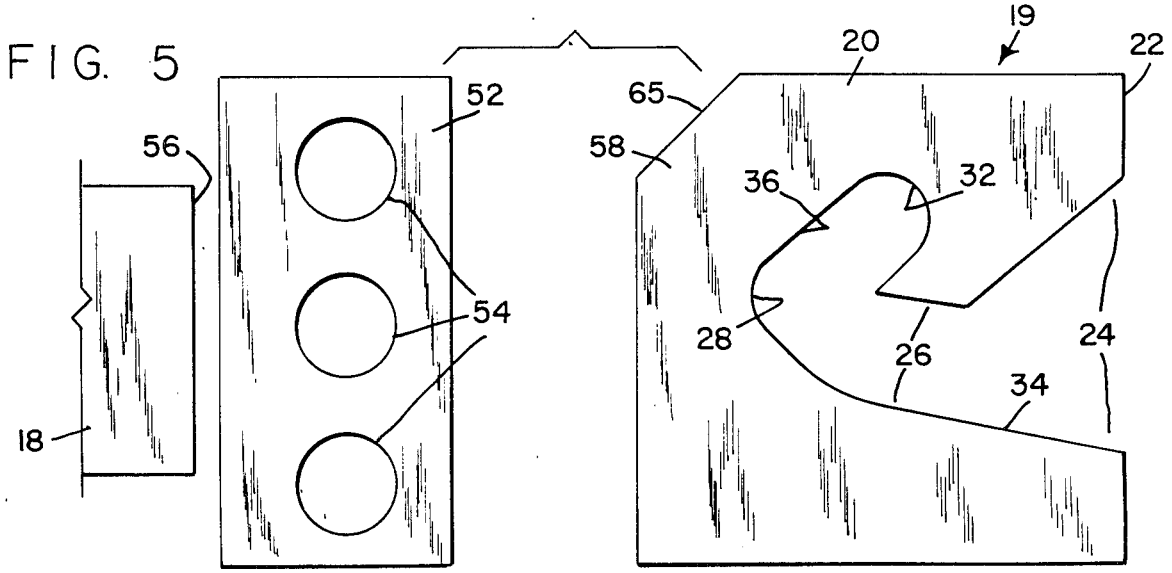
FIG. 5 shows one embodiment of a mounting tab of the present invention which is adapted to be mounted to a conventional plow frame.

Referring to FIGS. 5 and 6, the mounting tab 19 of the present invention is adaptable for mounting to an existing plow supporting frame which includes a plate-like mounting tab 52 which is attached to the end of one of the rearwardly extending arms 18 of the supporting frame. The tab 52 is provided with a plurality of apertures 54 for receiving the connecting pin of the push beam. The tab 19 is attached to the supporting frame by, first, removing the tab 52 from the arm 18. This can be accomplished by a hack saw or simply by an acetylene torch. Once the tab 52 is removed from the arm 18, the mounting tab 19 of the present invention is then applied to the end of the arm 53 by welding the forward edge 58 of the tab 19 to the rearward free edge 56 of the arm 18. The upper forward edge of each tab 19 is beveled at 65 as an aid in properly aligning the tab 19 on the forward edge of the arm 18. The bevel 65 is designed so that when the forward edge of the bevel is positioned against the upper rearward edge of the arm 18, the tab 19 is properly positioned on the arm 18.

FIRST MODIFIED MOUNTING TAB

Referring to FIGS. 6 thru 8 there is shown a first modified mounting tab, generally indicated by the reference numeral 60. Mounting tab is identical to mounting tab 19 with respect to the rearward opening and first and second slots. All portions of tab 60 which are identical to portions of tab 19 are identified with the same reference numerals with the addition of a prime. The mounting 60 is provided with a mounting bracket 62 which is offset from the general plane of the plate 20'. The bracket 62 comprises a pair of apertures 64 which are adapted to be aligned with the upper and lower apertures 54 of the conventional mounting tab 52 when the bracket 62 is positioned against the tab 52 as shown in FIGS. 7 and 8. The mounting tab 60 is attached to the conventional tab 52 by fastening means, such as bolts 66 which are inserted through the apertures 54 and 64 and locked in place by a nut 68. The bracket 62 is offset from the plate 20' by an amount equal to the thickness of the plate. This enables the plate 20' to lie in the same plane as the conventional mounting tab 52 when the bracket is attached to the conventional mounting tab as shown in FIG. 8.

SECOND MODIFIED MOUNTING TAB

Referring particularly to FIGS. 9 thru 11 there is shown a second modified mounting tab, generally indicated by the reference numeral 70. Mounting tab 70 includes a flat plate 20" which is similar to plate 20 with respect to the portions of the plate which interact with the connecting pins of the push beam. Comparable elements of plates 20 and 20" are identified with the same reference numeral except that the elements of plate 20" include a double prime. Plate 20" includes a bracket 72 which is an extension of the plate 20 and lies in the same plane as the plate. Bracket 72 includes a pair of apertures 74 which are adapted to be aligned with the upper and lower apertures 54 of the conventional mounting tab 52, when the bracket 72 is positioned against the mounting tab 52 as shown in FIG. 11. The mounting tab 70 is attached to the conventional mounting tab 52 by fastening means such as bolts 76. The bolts 76 are extended through the apertures 74 and 54 and locked in place by nuts 78. Since the plate 20" and the brackets 72 are in the same plane, when the bracket 72 is attached to the conventional mounting tab 52, the plate 20 is offset from the plane of the conventional mounting tab. In order to maintain the correct alignment with the guide slots 44 of the push beam 38, one of the mounting tabs 70 is attached on the inside of its respective conventional mounting tab 52 and the other mounting tab 70 is attached to the outside of its respective conventional mounting tab 52. The plow is, therefore, shifted slightly to one side of the plow vehicle, but only the inconsequential distance of the thickness of the conventional mounting tab. One advantage of the mounting tabs 70 is that it is simple in construction. The advantage of the first and second mounting tabs 60 and 70, respectively, is that neither tab requires the removal of the conventional mounting tab and subsequent welding of the mounting tab of the present invention. The advantage of the mounting tab 19 is that the forward position of each pin 50, when it comes to rest against the forward edge 28, is the same as for the conventional mounting tab relative to the supporting frame of the plow. This means that leverage factors are unchanged and that there is no changes in operating force for the plow.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Coupling for a plow comprising:

(a) a supporting frame which is attachable to the back side of a plow, said frame having a pair of spaced rearwardly extending arms, and (b) a mounting tab which is rigidly attached to the rearward end of each arm, said tab comprising a flat plate which includes a rear edge, an opening at said rear edge, a first slot which extends forwardly from the opening and which terminates in a forward edge, and a second slot which extends rearwardly from the forward end of said first slot and which terminates in a rearward edge, said opening being adapted to receive a connecting pin of a push beam which is attached to a plow pushing vehicle, when said rear edge is moved toward said pin at a right angle to the longitudinal axis of said pin, said first slot being adapted to receive said pin so that the pin rests against said forward edge when the plow is pushed forwardly by the vehicle and said second slot being adapted to receive said pin from said first slot so that said pin rests against said rearward edge when the plow is being pulled rearwardly by the vehicle.

2. Coupling as recited in claim 1, wherein said first slot is inclined from said opening and said second slot is inclined from said first slot.

3. Coupling as recited in claim 1, wherein the first slot has a lower edge and the second slot has an upper edge, said lower and upper edges being connected to said forward edge.

4. Coupling as recited in claim 1, wherein said forward edge is curved.

5. Coupling as recited in claim 1, wherein said rearward edge is curved.

6. Coupling as recited in claim 1, comprising:

(a) a cross brace which is fixed to said arms at a point which is rearward of the center of gravity of the combined frame and plow, and (b) releasable connecting means which are attachable to lifting element of the plow vehicle and engageable with the cross brace so that when the lifting element and the brace are substantially vertically aligned, the lifting element is effective to raise the mounting tabs relative to said pins and the lifting element is effective to disengage from the brace when said lifting element is at a predetermined rearward point of said brace due to rearward movement of the plow vehicle relative to the supporting frame, said pins being located sufficiently rearward relative to said mounting tabs so as to disengage from said mounting tabs at the point of disengagement of said connecting means with said bracket.

7. Mounting tab for a plow coupling having a supporting frame which is attachable to the back side of a plow and a pair of spaced rearwardly extending arms, said mounting tab comprising:

(a) a flat plate having a rear edge, (b) an opening at said rear edge which is adapted to receive a connecting pin which is located at the forward side of the push beam of a plow vehicle when said rear edge is moved toward said pin at a right angle to the longitudinal axis of said pin, (c) a first slot which extends forwardly from said opening and which terminates in a forward edge, said first slot being adapted to receive said pin so that the pin rests against said forward edge when the plow is pushed forwardly by the vehicle, (d) a second slot which extends rearwardly from the forward end of the first slot and which terminates in a rearward edge, said second slot being adapted to receive said pin from said first slot so that said pin rests against said rearward edge when the plow is being pulled rearwardly by the vehicle, and (e) connecting means for rigidly attaching the tab to the rear end of one of said arms.

8. Mounting tab as recited in claim 7, wherein said arm has a free rear edge and said connecting means is a forward edge of said flat plate which is weldable to said free rear edge.

9. Mounting tab as recited in claim 7, wherein a preexisting mounting tab is attached to said arm and said preexisting mounting tab has a plurality of apertures, and wherein said connecting means comprises a bracket which is adapted to be mounted on said preexisting tab.

10. Mounting tab as recited in claim 9, wherein said bracket has a pair of holes which are adapted to be aligned with two of the apertures in said preexisting tab for receiving a pair of fastening elements.

11. Mounting tab as recited in claim 9, wherein said bracket is parallel with, but offset from said tab so that when said bracket is mounted on said preexisting tab the mounting tab lies in the same plane as said preexisting tab.

12. Mounting tab as recited in claim 9, wherein said bracket lies in the same plane as said mounting tab.

13. Mounting tab as recited in claim 7, wherein said forward edge is curved.

14. Mounting tab as recited in claim 13, wherein said forward edge has a radius of curvature which is substantially equal to the radius of the connecting pin.

15. Mounting tab as recited in claim 7, wherein said rearward edge is curved.

16. Mounting tab as recited in claim 15, wherein said rearward edge has a radius of curvature which is substantially equal to the radius of the connecting pin.

17. Coupling as recited in claim 7, wherein said releasable connecting means comprises:

(a) an L-shaped bracket which has a first leg and a second leg which extends at an angle to said second leg, and (b) a chain which is connected to the free end of said first leg and adapted to be connected to said lifting element so that said L-shaped bracket can be positioned at the rear of said brace so that said first leg is in back of the rear edge of said brace and said second leg is beneath said brace.

18. Coupling as recited in claim 7, wherein said releasable connecting means comprises:

(a) a notch in the rear edge of said brace, and (b) a chain which is adapted to be connected to said lifting element and for extending into said notch for engaging said brace.

* * * * *